US005551839A

United States Patent [19]

Schuster et al.

[11] Patent Number: 5,551,839

[45] Date of Patent: Sep. 3, 1996

[54] PUMP HOUSING FOR ROTARY PUMPS

[75] Inventors: Oliver Schuster, Bobstadt; Axel Riel; Kurt Seitz, both of Frankenthal, all of Germany

[73] Assignee: KSB Aktiengesellschaft, Frankenthal, Germany

[21] Appl. No.: 331,526

[22] PCT Filed: Apr. 24, 1993

[86] PCT No.: PCT/EP93/00992

§ 371 Date: Oct. 28, 1994

§ 102(e) Date: Oct. 28, 1994

[87] PCT Pub. No.: WO93/22564

PCT Pub. Date: Nov. 11, 1993

[30] Foreign Application Priority Data

Apr. 29, 1992 [DE] Germany ..... 42 14 026.9

[51] Int. Cl.[6] ..... F04D 29/44

[52] U.S. Cl. ..... 415/212.1; 415/215.1

[58] Field of Search ..... 415/204, 212.1, 415/215.1

[56] References Cited

U.S. PATENT DOCUMENTS

| | | | |
|---|---|---|---|
| 1,109,393 | 9/1914 | Blackstead | 415/204 |
| 1,997,387 | 4/1935 | McCord | 415/212.1 |
| 2,999,628 | 9/1961 | Crombie | 415/204 |
| 4,398,867 | 8/1983 | Dernedde et al. . | |
| 5,069,599 | 12/1991 | Carretta . | |
| 5,112,190 | 5/1992 | Kajiwara et al. | 415/215.1 |
| 5,133,642 | 7/1992 | Kajiwara | 415/215.1 |
| 5,184,937 | 2/1993 | Arakawa et al. | 415/212.1 |

FOREIGN PATENT DOCUMENTS

| | | | |
|---|---|---|---|
| 0839598 | 4/1931 | Germany | 415/215.1 |
| 2300040 | 9/1973 | Germany | 415/212.1 |
| 3000095 | 1/1980 | Germany . | |
| 3316927 | 11/1984 | Germany . | |
| 0300716 | 11/1936 | Italy | 415/212.1 |
| 017473 | 4/1915 | United Kingdom . | |
| 580079 | 2/1945 | United Kingdom . | |
| 0800548 | 8/1958 | United Kingdom | 415/212.1 |

*Primary Examiner*—Edward K. Look
*Assistant Examiner*—Mark Sgantzos
*Attorney, Agent, or Firm*—Darby & Darby, P.C.

[57] ABSTRACT

A standard pump housing is provided for rotary pumps having impellers with various delivery heads and flow rates. The pump housing can be manufactured by a simple sheet metal shaping technique, is very stiff even at the joint of the pressure pipe and achieves the best possible efficiency. The pump housing has a flattened part at its circumference which narrows the flow room arranged downstream of the impeller and delimited by the pump housing, in the direction of the pump axis. An opening for connecting with a pipe having a standard connection cross-section is arranged in the flattened part of the housing.

8 Claims, 2 Drawing Sheets

PUMP HOUSING FOR ROTARY PUMPS

BACKGROUND OF THE INVENTION

A rotary pump is known from DE-A-33 16 927 that is comprised of a housing divided into two identical housing halves by a plane that is located perpendicular to the housing axis and running through the middle of the housing and is preferably made of plastic. The housing has a separately-formed outlet pipe that is connected to a lateral outlet opening provided on the external periphery of the housing. In one embodiment of the housing, the direction of its outlet opening is offset to the center axis of the housing. In addition, the interior chamber of the pump housing extends into the connection area of the outlet pipe. The outlet opening of the housing is provided with a flange, so that the outlet pipe can be mounted on the bearing surface of the housing with a corresponding rectangular connection flange. The rotary pump is adapted to various requirements through the use of outlet pipes of corresponding different shapes. The two-part embodiment of the housing with identical housing halves, which has an opening for securing to a pump or to receive a cover with an inlet opening, restricts the usable area. For ease of assembly, the impeller may not be larger than said opening. Consequently, the pump has an impeller diameter that is much smaller than the diameter of the housing, and adjustment of its power is restricted with regard to delivery heads and flow rates. The rotary pump shown in the illustration is a non-clogging pump used to convey high flow rates of contaminated water containing a great deal of grease. Therefore, the pump is not intended for the build-up of high pressures. Furthermore, this design has the disadvantage that many parts must be assembled. In addition to the housing parts, seals and connecting elements are required. The way in which the parts are connected requires flanges, and gaps in which deposits can form are produced between the parts.

DE-A-30-00 095 shows a centrifugal pump having a pump housing that has a discharge disposed substantially tangentially in relation to the wall enclosing the pump housing, whereby the discharge has an opening with a substantially rectangular cross section. That opening diminishes the stiffness of the housing and does not provide any additional protection against the deformation forces caused by the internal pressure. Welding to the pipe is difficult, since the welded seam runs in three planes. For that reason, the pipe is designed in such a way that it can be mounted on the three-dimensional contour of the housing.

SUMMARY OF THE INVENTION

The aim of the invention is to create a standard pump housing for impellers with various delivery heads and flow rates that can be manufactured with a simple sheet metal shaping technique, is very stiff even at the joint, and achieves the best possible efficiency.

The aim is achieved in accordance with the invention in that a flattened part is disposed on the housing circumference, the flattened part narrows the flow chamber arranged downstream of the impeller and delimited by the pump housing in the direction of the pump axis, and an opening for connecting with a pipe having a standard connection cross-section is arranged on the flattened part.

The advantages provided by the invention are comprised in particular of the fact that flattening the pump housing allows reliable connection of the pipe with the hosing by welding in one plane. In that regard, a connection with no gaps can be produced that allows sensitive pump media to be conveyed. The flattened part also increases the stiffness of the housing. The pump housing is primarily developed to be manufactured using a sheet metal shaping technique, but is also equally suitable to be manufactured using other technologies and other materials.

A further development has the advantage that enlarging the surface area of the flattened part makes it easier to connect the pipe with the housing because sufficient room is created for automated welding. It is essential that the surface on the connection cross section of the pipe remains constant for the use of pipes of various shapes on one housing.

A further development allows control of the flow to be changed, in that an asymmetrical arrangement of the opening and the pipe with regard to the flattened part promotes the formation of a spur without the use of an additional part. The opening is advantageously offset against the direction of flow, which enlarges the spur.

A further development optimizes flow control in such a way that on the one hand the transition radii from the pump housing into the flattened part promotes the spur formation and on the other hand the flow from the housing into the pipe is improved. In that regard, the radius located toward the front in the direction of flow should be small, and the radius located at the back in the direction of flow should be large.

The collar oriented toward the exterior of the flattened part is used, in addition to receiving any chosen pipe with a specified connection cross section, to guide the pipe in the overlap area. The collar also helps to stiffen the housing. The pipe is preferably welded to the collar, whereby the pipe may be located inside or outside of the collar.

Welding without a gap is achieved in this embodiment by welding the pipe onto the collar from the inside.

A further development relates to a pump housing with the flattened part disposed parallel to the axis of rotation of the impeller; a further development relates to a pump housing with a flattened part at an angle to the axis of rotation of the impeller.

BRIEF DESCRIPTION OF THE DRAWINGS

An example of an embodiment of the invention is presented in the illustration and described in greater detail below. In the illustrations.

DESCRIPTION OF THE PREFERRED EMBODIMENT

Figure 1:
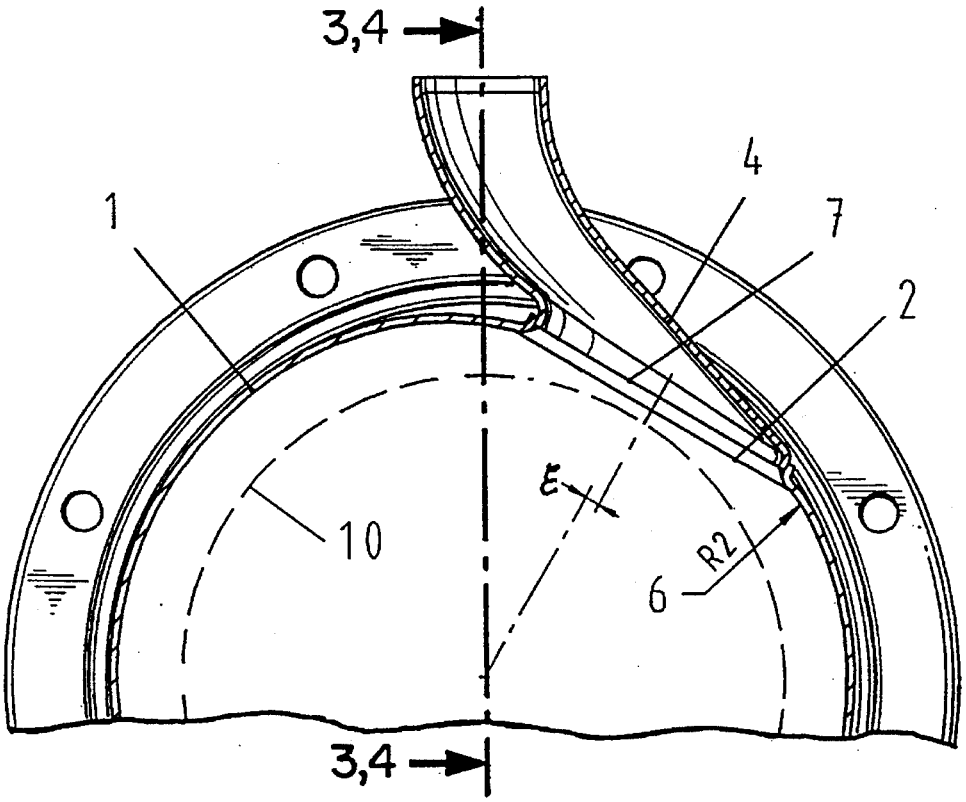
FIG. 1 shows a pump housing in longitudinal section.
Figure 2:
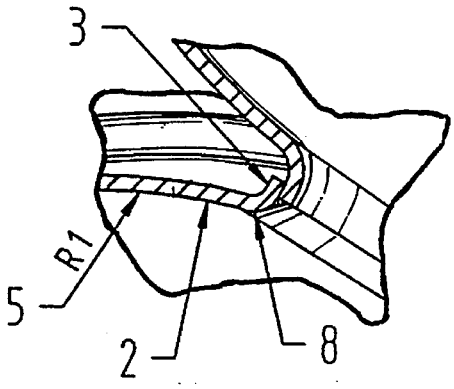
FIG. 2 shows an enlargement of the transition from the housing into the flattened part.

In FIGS. 1 and 2 a cylindrical pump housing 1 made of sheet metal has on its housing circumference a flattened part 2 with a collar 3 to receive a pipe 4. In this embodiment the pipe 4 is a pressure pipe having a flange (not shown) on its end. The flattened part 2 emerges from the cylindrical housing 1 with two different bending radii R1 and R2 at locations 5 and 6 and is inclined at an angle of approximately 30° from the tangents of the circumference of the cylindrical housing. The flattened part does not intersect the periphery of the impeller 1 in this case, but that is entirely acceptable. The center axis of the opening 7 on the flattened part 2 does not go through the center point of the housing 1, but instead is offset by distance E from the direction of flow. That promotes the formation of a spur 8.

FIG. 2 shows an enlargement of the transition from the housing 1 into the flattened part 2. The transition at location 5 is designed with a radius R1, which in this embodiment is larger than radius R2 at location 6. The spur 8 that is formed is produced by the flattened part 2.

Figure 3:
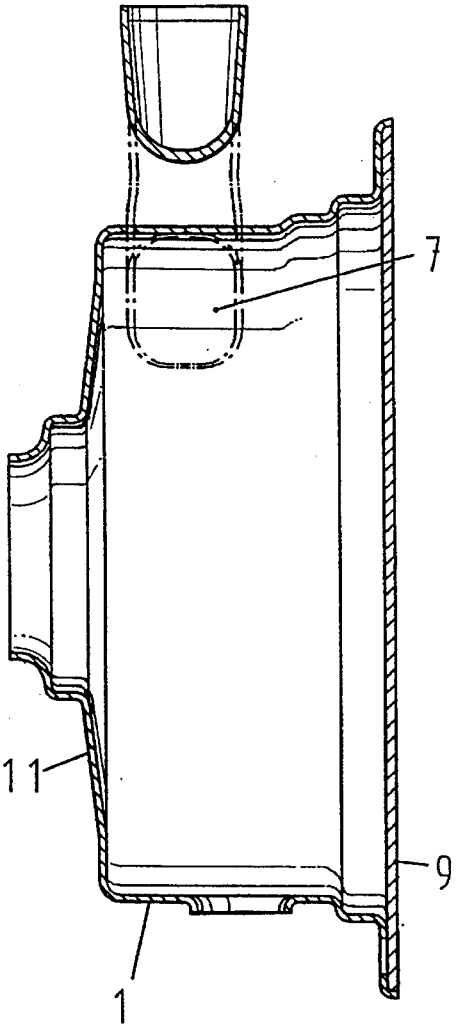
FIG. 3 shows a pump housing with pressure pipes in meridian section.
Figure 4:
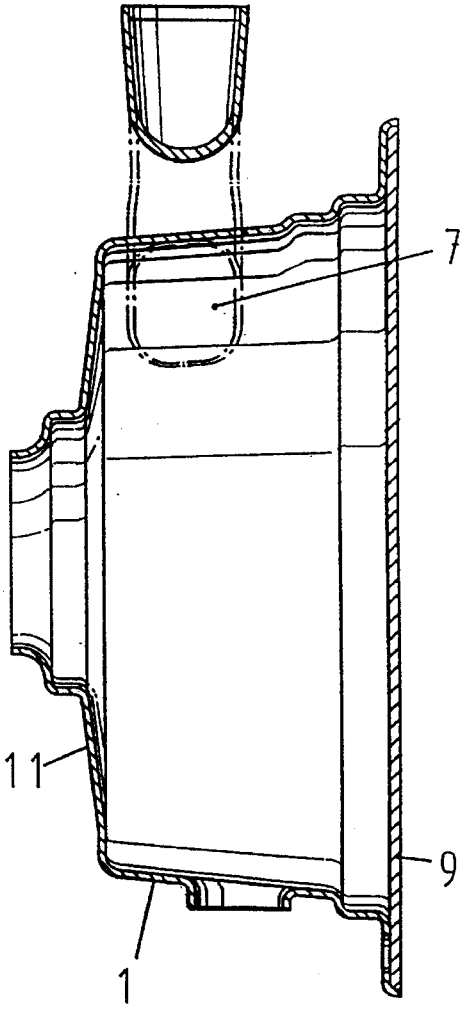
FIG. 4 shows a pump housing with pressure pipes in meridian section.

As shown in FIG. 3, the opening 7 does not extend over the entire width of the housing 1, but instead is at a distance from the front 11 and rear 9 housing walls. The illustrated cylindrical housing 1 may also be of another shape, for example parabolic, conical, spherical, or polygonal. FIG. 4 shows a conical housing 1 such that the flattened part 2 is disposed at an angle with respect to the axis of rotation of the impeller.

We claim:

1. A pump housing having a circumference, a flow chamber and a separately-formed pipe disposed on the housing circumference, the pipe being connected to an opening located on the outer housing circumference, wherein a flattened part (2) is provided on the housing circumference, the flattened part narrows the flow chamber delimited by the pump housing in the direction of the pump axis, the opening for connection of the pipe is mounted on the flattened part which has a two-dimensional flattened surface cross-section.

2. A pump housing in accordance with claim 1, wherein the surface of the flattened part is larger than the surface of the cross section of the opening.

3. A pump housing in accordance with claim 2, wherein the opening has a center point, a normal line of a plane of the flattened part in the center point of the opening does not intersect the impeller axis.

4. A pump housing in accordance with claim 2, wherein a first and subsequent transition radii and of the pump housing into the flattened part are different from each other.

5. A pump housing in accordance with claim 4, wherein the first transition radius in the direction of flow is smaller than the subsequent transition radius.

6. A pump housing in accordance with claim 1, wherein the opening on the flattened part is provided with a collar oriented toward the exterior of the housing to receive the pipe collar.

7. A pump housing in accordance with claim 1, wherein the flattened part is disposed parallel to the axis of rotation of the impeller.

8. A pump housing in accordance with claim 1, wherein the flattened part is disposed at an angle to the axis of rotation of the impeller.

* * * * *

UNITED STATES PATENT AND TRADEMARK OFFICE

CERTIFICATE OF CORRECTION

PATENT NO. : 5,551,839

DATED : September 3, 1996

INVENTOR(S) : Oliver Schuster, et. al.

It is certified that error appears in the above-indentified patent and that said Letters Patent is hereby corrected as shown below:

Title page, [30], Foreign Application Priority Data, change "42 14 026.9" to --P 42 14 026.9--.

Signed and Sealed this

Eighth Day of April, 1997

Bruce Lehman

*Attest:*

BRUCE LEHMAN

*Attesting Officer*

*Commissioner of Patents and Trademarks*